US006301765B1

(12) United States Patent
Arns et al.

(10) Patent No.: US 6,301,765 B1
(45) Date of Patent: Oct. 16, 2001

(54) PROCESS FOR MANUFACTURING A HOLLOW BODY FROM TWO PLATES

(75) Inventors: Wilhelm Arns, Paderborn; Arndt Birkert, Bretzfeld-Unterheimbach; Matthias Schroeder, Gruenendeich, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/356,502

(22) Filed: Jul. 19, 1999

(30) Foreign Application Priority Data

Jul. 17, 1998 (DE) ..... 198 32 142

(51) Int. Cl.[7] ..... B23P 17/00
(52) U.S. Cl. ..... 29/421.1; 72/61
(58) Field of Search ..... 29/897.2, 407.08, 29/421.1; 72/54, 60, 61

(56) References Cited

U.S. PATENT DOCUMENTS

| | | | | |
|---|---|---|---|---|
| 2,882,588 | * | 4/1959 | Reippel et al. | 29/421.1 |
| 2,949,875 | * | 8/1960 | Adams | 72/60 |
| 3,512,239 | * | 5/1970 | Rosenblad | 29/421.1 |
| 4,306,436 | * | 12/1981 | Schulz et al. | 72/60 |
| 5,711,059 | | 1/1998 | Schaefer | 29/423 |

FOREIGN PATENT DOCUMENTS

| | | |
|---|---|---|
| 2 007 400 | 8/1971 | (DE) . |
| 44 16 147 | 11/1995 | (DE) . |
| 0 589 370 | 3/1994 | (EP) . |

* cited by examiner

*Primary Examiner*—P. W. Echols
*Assistant Examiner*—Jermie E. Cozart
(74) *Attorney, Agent, or Firm*—Crowell & Moring LLP

(57) ABSTRACT

A method and a device for manufacturing a hollow body from two plates, which are placed against one another and inserted into an internal high pressure forming tool. After the forming tool is closed, a fluid is introduced under high pressure between the plates by way of an expansion lance inserted between the plates. The plates are expanded until they abut the interior surfaces of the forming tool that match the shape of the hollow body. To achieve a process-reliable manufacture of the hollow body, the plates, before any internal high pressure is developed, are pinched in the thickness direction along the circumference of the opening that surrounds the inserted expansion lance by cooperation between the dies of the forming tool and the circumferential contour of the expansion lance that is oversize relative to the location between the plates at which the expansion lance is introduced. During the expansion process produced by internal high pressure, plate material is pushed by way of a stop located on the expansion lance and abutting the plate edges, toward the mold chamber formed by the interior surfaces of the dies.

12 Claims, 2 Drawing Sheets

PROCESS FOR MANUFACTURING A HOLLOW BODY FROM TWO PLATES

BACKGROUND AND SUMMARY OF THE INVENTION

This application claims the priority of German patent 198 32 142.2, filed Jul. 17, 1999, the disclosure of which is expressly incorporated by reference herein.

The invention relates to a method for manufacturing a hollow body from two plates, which are inserted resting against one other into an internal high pressure forming tool, and, after the forming tool is closed, by introducing a fluid under high pressure between the plates by way of an expansion lance inserted between them, are pushed apart until they abut the hollow in the forming tool that matches the shape of the hollow body. The invention also relates to a device for manufacturing a hollow body from two plates placed against one another, with an internal high pressure forming tool and an expansion lance that can be introduced between the plates and has a feed bore for introducing a fluid under high pressure between the plates, with the forming tool having a mold chamber formed by its hollow parts which corresponds to the shape of the hollow body to be formed.

A method and a device of the type generally described above are known from German patent document DE 44 16 147 A1 (corresponding to U.S. Pat. No. 5,711,059). In this document, two plates are placed against one another and welded together edgewise in their lengthwise direction, and this combination of plates is then placed in an internal high pressure forming tool, which has a mold chamber formed by the hollows of the dies of the forming tool. The forming tool is then closed, whereupon the plates are clamped between the dies with a high force. To introduce the pressure fluid between the plates, a splitting chisel is introduced between the plates and the hole left by the chisel is used to fill the plates with a pressure fluid under high pressure. The plates subjected to this pressure then expand in the area of the mold chamber. However, it is disadvantageous that when the objects to be shaped are large, the insertion of the plate edges is restricted by the closing force of the forming tool acting on the plates in such fashion that the stretch limit of the material is soon reached and tears develop in the resultant hollow profile, causing the forming process to be interrupted.

It is known from European patent document EP 0 589 370 A1 that when the plates are being manufactured, shapes can be produced in them so that a channel results when they are placed against one another, said channel permitting easier penetration of high-pressure fluid between the plates. After the two plates are joined, the plate combination is inserted into an internal high-pressure forming tool and the tool is closed. The closing force of the forming tool determines the clamping force for the plates located in between. At the filling opening from which the channel takes its departure, a conical mandrel or a lance provided with a feed bore is applied, sealed by an annular bead. Then the fluid, under high pressure, flows through the feed bore between the plates and spreads them. As a result, when a hollow profile is produced from the two plates, the problems outlined above regarding the reliability of the process and the method occur.

The goal of the invention is to improve a method and a device for manufacturing a hollow body from two plates such that reliable manufacture of the hollow body is achieved.

This and other goals have been achieved according to the present invention by providing a method for manufacturing a hollow body from two plates, comprising the acts of: placing two plates resting against each other into an internal high pressure forming tool having an interior surface defining a mold chamber; inserting an expansion lance between the plates, the plates being pinched between the forming tool and a circumferential contour of the expansion lance at an opening between the plates; introducing a fluid under high pressure between the plates via said expansion lance, said fluid pushing the plates apart until the plates abut the interior surface of the forming tool; and pushing material of said plates toward the mold chamber via a stop located on said expansion lance which abuts edges of said plates, during said introducing act.

This and other goals have been achieved according to the present invention by providing a device for manufacturing a hollow body from two plates, comprising: an internal high pressure forming tool having an interior surface defining a mold chamber corresponding to a shape of the hollow body, said forming tool receiving two plates resting against each other; an expansion lance insertable between the plates via an axial drive, the expansion lance and the axial drive forming a pushing plunger, the expansion lance having a pinching section along a circumferential contour, the plates to be pinched between said pinching section and the forming tool, said expansion lance including a feed bore communicable with a high pressure fluid source, said expansion lance defining an axial stop to abut axial edges of the plates, said axial stop having a radial periphery which is smaller than that of the mold chamber.

According to the invention, plate material is actively fed from the edge area to the mold chamber so that the tensile stresses that result from the clamping of the plates between the dies and the expansion lance are reduced, and the threshold of stretching is raised. The resultant thinning of the material is counteracted so that tears do not result in the material that lead to the bursting of the hollow body being formed. Consequently, hollow bodies can be produced even with high degrees of forming (>30 percent), in other words voluminous hollow bodies, without there being the danger of a breakdown in production caused by damage. As a result of the clamping of the plates by pinching, a higher degree of sealing ability is achieved which is extremely beneficial for the reliability of the process in working the manufacturing method.

Other objects, advantages and novel features of the present invention will become apparent from the following detailed description of the invention when considered in conjunction with the accompanying drawings.

DETAILED DESCRIPTION OF THE DRAWINGS

Figure 1:
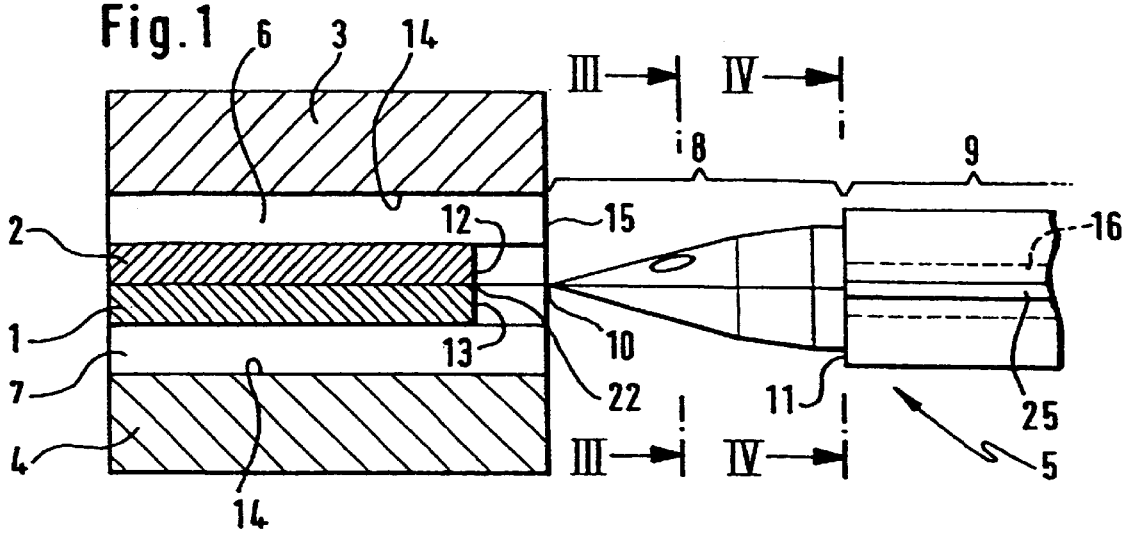
FIG. 1 shows a portion of the device according to a preferred embodiment of the present invention in the non-use position in a lateral lengthwise section.

FIG. 1 shows a device for manufacturing a hollow body from two plates 1 and 2 placed against one another, which contains a divided internal high pressure forming tool with an upper die 3 and a lower die 4 and an expansion lance 5. In the corners of matrices 3 and 4 there are drain channels that lead out of the tool and carry away the fluid that remains in the tool from previous expansion processes. Even in the case of large volumes of air or water, this guarantees production of a hollow body with the desired contour.

Figure 5:
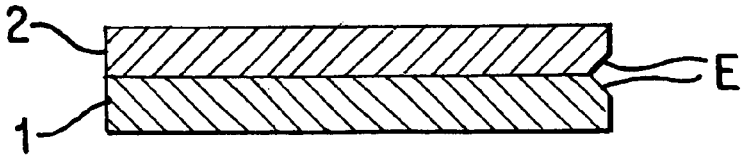
FIG. 5 shows the two plates in a lateral lengthwise section, each formed with a bead (E).

FIG. 5 shows the two plates in a lateral lengthwise section, each formed with a crimp (E), as schematically illustrated.

The forming tool in the figure is shown in the closed position, with the plates 1 and 2, which rest loosely against one another or are permanently connected together, clamped laterally by the forming tool. Plates 1 and 2 are free when the expansion lance 5 is in the non-use position, in other words not in contact with the dies 3 and 4, defining two spreading gaps 6 and 7, which lead into the mold chamber of the forming tool divided by plates 1 and 2. The mold chamber is formed by the hollows of the dies 3 and 4 and matches the shape of the hollow body to be formed.

The expansion lance 5 is essentially lenticular in cross section (FIGS. 3 and 4) and comprises two sections 8 and 9. Section 8 has an end 10 that penetrates when the expansion lance 5 is in the use position, said end being made flat and with sharp edges and extending linearly in a front view. From this end 10, section 8 expands slightly conically assuming a lenticular contour. Section 8 directly abuts section 9 which is likewise made lenticular, but with formation of a shoulder 11 stepwise relative to section 8 and extending all the way around.

Shoulder 11 in the use position of expansion lance 5 forms a stop for edges 12, 13 of plates 1 and 2. Shoulder 11 is dimensioned so that it covers the edges 12, 13 of the spread plates 1 and 2 uniformly but partially at least halfway, and is located at a slight distance from the interior surfaces 14 of the dies (defining the mold chamber) inside the end die opening 15. Dies 3 and 4 are then adapted as far as their openings 15 are concerned to the contour of expansion lance 5. Opening 15 is designed to be the mating form of section 9 of expansion lance 5 or with a slightly larger cross section.

Figure 3:
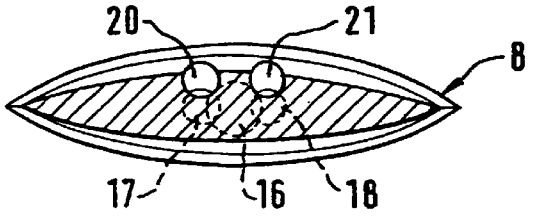
FIG. 3 shows the expansion lance of the device according to FIG. 1 in a cross section along line III—III.
Figure 4:
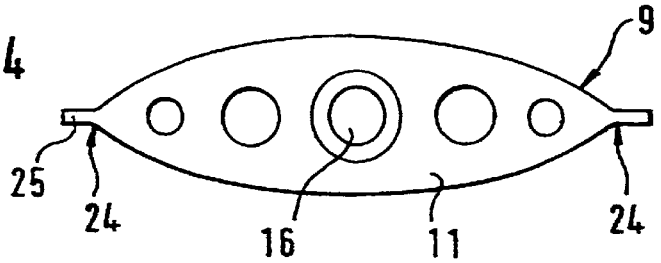
FIG. 4 shows the expansion lance of the device in FIG. 1 in a cross section along line IV—IV.

A central pressure fluid channel 16 is defined in section 9, said channel being communicated at one end with a fluid high pressure generating system. The pressure fluid channel 16 communicates with through feed bores 17 and 18 at the transition to section 8, said bores extending eccentrically in section 8 and having outlet openings 20 and 21 in the upper circumferential area 19 of the lenticular shape of section 8 of the expansion lance (FIG. 3). The feed bores 17 and 18 rise to the outlet openings 20 and 21 so that after expansion lance 5 is retracted after the expansion of the plate combination has been completed, the pressure fluid is prevented from escaping, which also results in a saving in the amount of pressure fluid to be supplied. As a result of the eccentric arrangement of the outlet openings 20 and 21, when the expansion lance 5 is driven in, they do not come in direct contact with the plate material between plates 1 and 2 so that removal of plate material caused by a possible sharp edge on the outlet openings 20 and 21 is avoided and consequently an undesired limitation of the sealing ability of the device by chips adhering to the sealing surfaces of plates 1 and 2 and to expansion lance 5 is prevented. Section 8 is mounted on section 9 by a plurality of mounting bolts. The two sections 8 and 9 however can also be joined together in one piece.

To manufacture a hollow body, plates 1 and 2 are placed against one another and inserted together into an internal high pressure forming tool. Instead of the two plates 1 and 2 being loose, they can be connected together at an edge area before they are inserted into the forming tool, preferably by welding. The welding can be performed in a continuous line all the way around or only on the long sides of plates 1 and 2 to form a welded seam. The welded seam can have a through opening at the point where expansion lance 5 is introduced. Plates 1 and 2 can be made with beads when they are produced or when they are cut to size, said beads forming an inlet channel for expansion lance 5 to facilitate its introduction when the plates 1 and 2 are placed against each other. In a preferred embodiment, the plates 1 and 2 are welded together all the way around, leaving a non-welded area.

After the plate combination is inserted, the forming tool is closed and the combination is clamped by pinching the edges between the dies 3 and 4. Expansion lance 5 is then guided to the parting seam 22 of plates 1 and 2 in the vicinity of the non-welded location via an axial drive that is connected with section 9 of expansion lance 5 and is driven between the plates 1 and 2. Plates 1 and 2 spread apart, whereupon they fill the spreading gaps 6 and 7 formed between dies 3 and 4 and the plate combination. During spreading, plates 1 and 2 slide along expansion lance 5, with the penetration of expansion lance 5 between plates 1 and 2 being facilitated by the conical shape of section 8. Expansion lance 5 is driven between plates 1 and 2 until the shoulder 11 of section 9 of expansion lance 5 abuts the plate edges 12 and 13.

Figure 2:
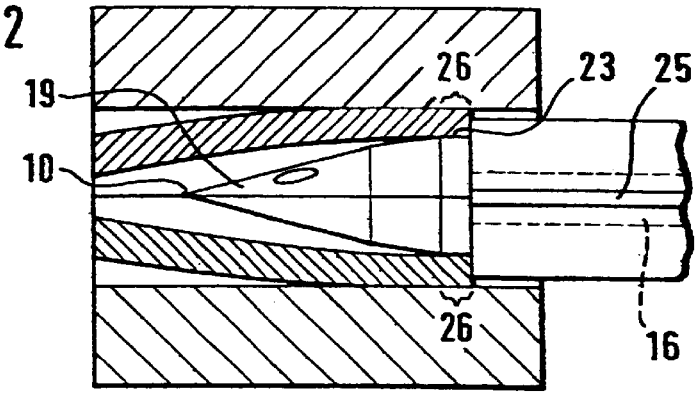
FIG. 2 shows the device in FIG. 1 in a lateral lengthwise section, with the expansion lance in the pinched position.

The area of section 8 of expansion lance 5 that directly borders section 91 with its circumferential contour 23 all the way around, is oversize relative to the cross section of the opening that is formed by the two plates 1 and 2 abutting dies 3 and 4 in the spread state and surrounding expansion lance 5, so that plates 1 and 2 are pinched there in the thickness direction between dies 3 and 4 and expansion lance 5 (FIG. 2). The high pinching force produces a high sealing ability of the expansion device. As a result of the conical shape of the area of section 8 that directly abuts section 9, the pinching force in the lengthwise direction of expansion lance 5 is limited only to a narrow strip 26 of the plate combination, which, after the hollow body has been formed, makes it easier to retract expansion lance 5 from the pinched position because the frictional forces are not that high. Because of the lenticular contour, a constant stress that is normal to the contact is achieved over the entire circumference of expansion lance 5, so that the sealing ability can be adjusted deliberately and no surface pressures that are too high develop at many points that could result in damage to expansion lance 5. It should be noted at this point that the oversize of circumferential contour 23 must be adjusted so that the pinching force is sufficiently high to guarantee a sufficient sealing ability, but is still so low that the expansion lance 5 and possibly dies 3 and 4, following retraction after forming, are not damaged because the surface pressure is too high. Approximately 10 percent of the plate thickness has been found to be a satisfactory degree of pinching. Damage caused by the surface pressure being too high is also counteracted by the fact that the stability of dies 3 and 4 and expansion lance 5 is increased by hardening. In any event, the surface pressure must be higher than the maximum internal pressure in the process in order to ensure tightness.

In the described pinched position of expansion lance 5, because of its lenticular shape, the lance fills the bore completely that results between expansion lance 5 and parting seam 22 of plates 1 and 2 because of their spread, so that the sealing ability of the expansion device is completely guaranteed at this point as well. It is especially helpful in this regard when the two edges of the welded seams that are located side by side at the point that is free on the welded seam are cut by the expansion lance 5 as it is driven in because of the oversize of the lance contour that is responsible for pinching the plates 1 and 2, so that an especially intimate shapewise fit between the expansion lance 5 and the plate combination is achieved. In addition, the lenticular shape provides advantages from the flow engineering standpoint since the flow friction is low and hence the cycle time of the expansion process can be reduced. For this purpose, the pressure fluid can be introduced for filling at a high volume flow and a low pressure (approximately 100 bars).

It is also contemplated to use any other shape for expansion lance 5 instead of the lenticular shape, but of course different surface pressures can develop which can have a disadvantageous effect on the long-term service life of the tool. In the case of those shapes that differ from lenticular, to ensure a complete sealing ability, it may be necessary that the expansion lance 5 be provided in the pinched cross section with a laterally projecting wing-like extension on each side at its circumferential contour in the vicinity of the middles of its long sides. This projection, in the pinched position of expansion lance 5, fills the respective bore in the vicinity of the parting seam 22. This extension must not be made completely flat, otherwise there would be a danger of breakage.

Of the shapes that differ from lenticular, those which essentially correspond to the desired shape of the formed hollow body at this point are preferred for expansion lance 5, so that the lance cross section in the use position, at the location of the pinched section and hence also the opening of the spread plates 1 and 2 in which the expansion lance 5 is pinched, corresponds to the cross section of the part to be formed. As a result of this design, subsequent trimming of the area of the pressure fluid inlet that does not conform to the shape of the part, in other words the docking area of the expansion lance 5 to the plate combination, is avoided.

In the clamping position of expansion lance 5, the pressure fluid is introduced between plates 1 and 2 through the central pressure fluid channel 16 of section 9 and of the two feed bores 17 and 18 of section 8 of expansion lance 5, so that as a result of the arrangement of outlet openings 20 and 21, the pressure force essentially is produced transversely to the lengthwise extent of expansion lance 5, so that the plates 1 and 2, because they are directly impacted, can be expanded more rapidly in the thickness direction.

Plates 1 and 2 are expanded until they abut the interior surfaces 14 of the forming tool that corresponds to the shape of the hollow body, so that in order to avoid tears in the hollow body that is forming, plate material is pushed toward the mold chamber defined by the interior spaces 14, while expansion lance 5 is advanced by the axial drive, whereupon the plate edges 12 and 13 are pushed together in the axial direction by shoulder 11 of section 9. In order to push with an engaged surface that is as large as possible, so that a uniform effect on plate edges 12 and 13 is achieved, the elliptical section 9, as an extension of its lateral crown 24, has a supporting shoulder 25 that extends in a straight line. Expansion lance 5 thus forms a pushing plunger together with the axial drive for the plate combination. The pushing force can be dimensioned here so that the plate edges 12 and 13 travel in a non-pinched friction-free movement of plates 1 and 2 in the direction of the mold chamber. However, it can also exceed the force of friction between plates 1 and 2 and the forming tool, if an accumulation of material in certain areas of the hollow body being formed is desirable, for example to produce greater mold depths for the expansion process or for deliberately reinforcing the hollow body.

In order to avoid nonuniform insertion of the plate edges 12 and 13 in the direction of the mold chamber, and in order to improve the reliability of the expansion process, the distribution of the closing force of the forming tool is checked before an expansion process. For this purpose, pressure strain gauges are placed on the plate combination and they change color to different degrees when the pressure is not uniform. Because of this pressure pattern and the use of a plurality of closing pressure cylinders distributed around the forming tool, their closing forces can be exerted to different degrees depending on the pressure pattern, so that the nonuniformity of a plate edge insertion that results in cracks can be compensated. In addition, the closing force of the forming tool must be sufficiently high to ensure tightness but it must not be so high that plate edge insertion is excessively hindered by high frictional feed stresses, since otherwise it can cause the part to burst as it is being formed.

It is also possible to measure plate edge insertion by directly scanning the plate edges 12 and 13 by a tactile method or by a laser, with the speed of the insertion movement being determined. With constant monitoring of a specific electronically stored setpoint curve for the part to be formed, the distribution of the closing force of the forming tool can always be optimally regulated over the pressing surface of the tool during the expansion process. As a result, the insertion movement can be controlled as needed.

It is also possible, instead of driving the expansion lance 5 in between plates 1 and 2, to insert one plate 1 into the forming tool first and then to place the expansion lance 5 at a suitable location on top plate 1, and then to place plate 2 on the expansion lance 5 and plate 1. Then the upper die 3 is moved against the lower die 4, and plates 1 and 2 are squeezed between the lance and the dies 3 and 4 in the thickness direction with the abutting expansion lance 5 in a certain location. It may be advantageous for the insertion of plates 1 and 2, before inserting plates 1 and 2, to provide each of them with a crimp (E) by embossing, in which expansion lance 5 is accommodated (as schematically shown in FIG. 5) With this alternate method, it is not necessary to drive the expansion lance 5 between plates 1 and 2, so that any chip removal that damages the plate material and which occurs as a result of inexact guidance of expansion lance 5 that is not directed exactly along parting seam 22, and can reduce the sealing ability of the expansion device by possible adhesion of chips to the pinching point, is prevented. Likewise, finely tuned control of the movement of expansion lance 5 until it strikes shoulder 11 at plate edges 12, 13 is not necessary. However, there is no frictional contact between expansion lance 5 and plates 1 and 2, as occurs when expansion lance 5 is driver in and which further increases the sealing ability of the expansion device.

The hollow body to be produced can be used in automobile construction, especially in building the body or manufacturing the axles.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for manufacturing a hollow body from two plates, comprising:

placing two plates resting against each other into an internal high pressure forming tool having an interior surface defining a mold chamber;

inserting an expansion lance between the plates, the plates being pinched between the forming tool and a circumferential contour of the expansion lance at an opening between the plates;

introducing a fluid under high pressure between the plates via said expansion lance, said fluid pushing the plates apart until the plates abut the interior surface of the forming tool; and pushing material of said plates in a direction toward an interior of the mold chamber in a direction parallel to the movement of the expansion lance via a stop located on said expansion lance which abuts edges of said plates, during said introducing step.

2. Method according to claim 1, wherein a pushing force used in said pushing step is set such that said edges move in the direction toward the interior of the mold chamber as if in a friction-free movement of plates.

3. Method according to claim 1, wherein a pushing force used in said pushing step exceeds a frictional force between the plates and the forming tool, causing an accumulation of material.

4. Method according to claim 1, wherein in said pushing step the plates are pinched with uniform pressure in a thickness direction by the cooperation of dies of the forming tool and a lenticular circumferential contour of the expansion lance.

5. Method according to claim 1, wherein said opening between the plates is formed during said inserting step by action of the expansion lance being driven into a parting seam located between the plates.

6. Method according to claim 1, further comprising, prior to said placing act, embossing crimps on the plates, said crimps at least partially defining said opening between the plates when the plates are placed against each other in the forming tool to facilitate said inserting step.

7. Method according to claim 1, wherein the plates are pinched in a thickness direction when the expansion lance is driven into a parting seam between the plates.

8. Method according to claim 1, further comprising, prior to said placing step, welding peripheral edges of the plates together such that a weld seam is formed therebetween, said weld seam being interrupted at a point between the plates at the which expansion lance is to be inserted.

9. Method according to claim 1, further comprising, prior to said placing step, welding peripheral edges of the plates together such that a weld seam is formed therebetween, wherein during said inserting step, the expansion lance cuts adjacent edges of the welded seam.

10. Method according to claim 1, wherein the plates are pinched with uniform pressure along a narrow strip that extends transversely to a lengthwise direction of the expansion lance.

11. Method according to claim 1, further comprising measuring movement of the plate edges, and controlling said movement of the plate edges by regulating a closing force of the forming tool, during said introducing and pushing steps.

12. Method according to claim 1, wherein said opening between the plates is formed by said circumferential contour of the expansion lance, said opening corresponding to a contour of the hollow body to be formed at said circumferential contour.

* * * * *